US006191081B1

(12) United States Patent
Cartwright et al.

(10) Patent No.: US 6,191,081 B1
(45) Date of Patent: Feb. 20, 2001

(54) LONG LIFE MEDIUM AND HIGH ASH OILS WITH ENHANCED NITRATION RESISTANCE

(75) Inventors: Stanley James Cartwright; James Walter Finch, both of Sarnia (CA)

(73) Assignee: ExxonMobil Research and Engineering Company, Annandale, NJ (US)

( * ) Notice: Under 35 U.S.C. 154(b), the term of this patent shall be extended for 0 days.

(21) Appl. No.: 09/464,530

(22) Filed: Dec. 15, 1999

(51) Int. Cl.[7] ..... C10M 141/12; C10M 159/22; C10M 159/24; C10M 159/20

(52) U.S. Cl. ..... 508/460; 508/391; 508/398; 508/586

(58) Field of Search ..... 508/460, 391, 508/398, 586

(56) References Cited

U.S. PATENT DOCUMENTS

| | | | | |
|---|---|---|---|---|
| 3,256,183 | | 6/1966 | Greenwald | 252/32.7 |
| 3,873,455 | | 3/1975 | Schieman | 252/32.7 E |
| 4,171,269 | | 10/1979 | Sung et al. | 252/33 |
| 4,181,619 | | 1/1980 | Schmitt et al. | 252/32.5 |
| 4,375,418 | | 3/1983 | Zoleski et al. | 252/33.4 |
| 4,764,296 | | 8/1988 | Kennedy | 252/334 |
| 4,792,410 | | 12/1988 | Schwind et al. | 252/38 |
| 4,925,579 | | 5/1990 | Stemke | 252/32.7 E |
| 4,954,273 | | 9/1990 | Denis et al. | 252/39 |
| 5,202,036 | | 4/1993 | Ripple et al. | 252/33.4 |
| 5,262,073 | | 11/1993 | Schmitt et al. | 252/33.2 |
| 5,318,710 | | 6/1994 | Campbell | 252/25 |
| 5,320,763 | | 6/1994 | Campbell | 252/25 |
| 5,328,620 | | 7/1994 | Ripple | 252/32.7 E |
| 5,547,597 | | 8/1996 | Koganei et al. | 508/409 |
| 5,691,283 | * | 11/1997 | Poat et al. . | |
| 5,719,107 | * | 2/1998 | Outten et al. . | |
| 5,726,133 | | 3/1998 | Blahey et al. | 508/390 |
| 5,792,735 | * | 8/1998 | Cook et al. . | |
| 5,804,537 | * | 9/1998 | Boffa et al. . | |
| 5,906,969 | | 5/1999 | Fyfe | 508/364 |
| 6,034,039 | * | 3/2000 | Gomes et al. . | |

FOREIGN PATENT DOCUMENTS

| | | | |
|---|---|---|---|
| 1136606 | 11/1982 | (CA) | C10M/1/48 |
| 1177472 | 11/1984 | (CA) | C01M/1/48 |
| 1189058 | 6/1985 | (CA) | C10M/169/00 |
| 298262A5 | 2/1992 | (DE) | C10M/159/22 |
| 299535A5 | 4/1992 | (DE) | C10M/159/22 |
| 0317348 | 5/1989 | (EP) | C10M/163/00 |
| 0317354 | 5/1989 | (EP) | C10M/163/00 |
| 0816477 | 1/1998 | (EP) | C10M/139/00 |
| 0620268 | 4/1999 | (EP) | C10M/163/00 |
| 60006790 | 1/1985 | (JP) | C10M/133/56 |
| 05295382 | 11/1993 | (JP) | C10M/163/00 |
| 07003279 | 1/1995 | (JP) | C10M/159/20 |
| 07247494 | 9/1995 | (JP) | C10M/169/04 |
| 08176583 | 7/1996 | (JP) | C10M/169/04 |
| 08283764 | 10/1996 | (JP) | C10M/163/00 |
| 10053784 | 2/1998 | (JP) | C10M/163/00 |
| 11001694 | 1/1999 | (JP) | C10M/159/22 |
| 104845 | 4/1930 | (RO) | C10M/105/68 |
| 99853 | 9/1990 | (RO) | C10M/135/10 |
| 94/28095 | 12/1994 | (WO) | C10M/135/18 |
| 96/01885 | 1/1996 | (WO) | C10M/163/00 |
| 96/19551 | 6/1996 | (WO) | C10M/141/12 |
| 96/37582 | 11/1996 | (WO) | C10M/135/18 |

* cited by examiner

*Primary Examiner*—Jerry D. Johnson
(74) *Attorney, Agent, or Firm*—Joseph J. Allocca

(57) ABSTRACT

A long life lubricating oil as evidenced by a reduction in viscosity increase, oxidation and nitration, comprises a major amount of a base oil of lubricating viscosity and a minor amount of a mixture of high TBN, medium TBN and low/neutral TBN detergents wherein metal salicylate detergent is at least one of the medium or low/neutral TBN detergents.

28 Claims, No Drawings

LONG LIFE MEDIUM AND HIGH ASH OILS WITH ENHANCED NITRATION RESISTANCE

FIELD OF THE INVENTION

The present invention relates to medium and high ash engine oils of extended life as evidenced by a reduction in viscosity increase, oxidation and nitration, comprising a base oil of lubricating viscosity and a particular combination of detergents.

BAC.KGROUND OF THE INVENTION

Natural gas fired engines are large, having up to 16 cylinders, and often generating between 500–3000 HP. The engines are typically used in the Oil and Gas industry to compress natural gas at well heads and along pipelines. Due to the nature of this application, the engines often run continuously near full load conditions, shutting down only for maintenance such as for oil changes. This condition of running continuously near full load places severe demands on the lubricant. Indeed, since the lubricant is subjected to a high temperature environment, the life of the lubricant is often limited by oil oxidation processes. Additionally, since natural gas fired engines run with high emissions of oxides of nitrogen ($NO_x$), the lubricant life may also be limited by oil nitration processes. Therefore, it is desirable for gas engine oils to have long life through enhanced resistance to oil oxidation and nitration.

The combustion of diesel fuel often results in a small amount of incomplete combustion (e.g., exhaust particulates). The incombustibles provide a small but critical degree of lubrication to the exhaust valve/seat interface, thereby ensuring the durability of both cylinder heads and valves. The combustion of natural gas is often very complete, with virtually no incombustible materials. Therefore, the durability of the cylinder head and valve is controlled by the properties of the lubricant and its consumption rate. For this reason, gas engine oils are classified according to their ash content, since it is the lubricant ash which acts as a solid lubricant to protect the valve/seat interface. The oil industry has accepted guidelines which classify gas engine oils according to their ash level. The classifications are:

| Ash Designation | Ash Level (wt %. ASTM D874) |
|---|---|
| Ash less | Ash < 0.1% |
| Low Ash | 0.1 < Ash < 0.6 |
| Medium Ash | 0.6 < Ash < 1.5 |
| High Ash | Ash > 1.5 |

The ash level of the lubricant is often determined by its formulation components, with metal-containing detergents (e.g., barium, calcium) and metallic-containing antiwear additives contributing to the ash level of the lubricant. For correct engine operation, gas engine manufacturers define lubricant ash requirements as part of the lubricant specifications. For example, manufacturers of 2-cycle engines often require the gas engine oil to be Ashless in order to minimize the extent of harmful deposits which form on the piston and combustion chamber area Manufacturers of 4-cycle engines often require the gas engine oils to be Low, Medium or High Ash to provide the correct balance of engine cleanliness, and durability of the cylinder head and valves. Running the engine with too low an ash level will likely result in shortened life for the valves or cylinder head. Running the engine with too high an ash level will likely cause excessive deposits in the combustion chamber and upper piston area.

Gas engine oil of enhanced life as evidenced by an increase in the resistance of the oil to oxidation, nitration and deposit formation is the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one alkali or alkaline earth metal salt having a Total Base Number (TBN) of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti-oxidants (about 0.05 to 1.5 vol %), metal deactivators such as triazoles, alkyl substituted dimercaptothiadiazoles (about 0.01 to 0.2 vol %), anti wear additives such as metal di thiophosphates, metal dithiocarbamates, metal xanthates or tricresylphosphates (about 0.05 to 1.5 vol %), pour point depressants such as poly (meth) acrylates or alkyl aromatic polymers (about 0.05–0.6 vol %), anti foamants such as silicone antifoaming agents (about 0.005 to 0.15 vol %), and viscosity index improvers, such as olefin copolymers, polymethacrylates, styrene-diene block copolmyers, and star copolymers (up to about 15 vol %, preferably up to about 10 vol %).

SUMMARY OF THE INVENTION

The present invention relates to a lubricating oil of extended life as evidenced by reductions in viscosity increase, oxidation and nitration, relative to current commercial and reference oils, which comprises a major amount of a base oil of lubricating viscosity and a minor amount of a mixture of metal salicylate detergent(s) and a metal sulfonate and/or metal phenate detergent(s). The present lubricating oil would be particularly useful as a medium ash or high ash gas engine oil.

DETAILED DESC.RIPTION OF THE INVENTION

A lubricating oil composition is described comprising a major amount of a base oil of lubricating viscosity and a minor amount of a mixture of one or more metal salicylate detergent(s), and one or more metal phenate(s) and/or metal sulfonate detergents. Also described is a method for extending the life of lubricating oils as evidenced by a reduction in viscosity increase, oxidation and nitration by adding to the oil an additive comprising a mixture of one or more metal salicylate detergent(s), and one or more metal sulfonate(s) and/or one or more metal phenate(s).

The lubricating oil base stock is any natural or synthetic lubricating base oil stock fraction typically having a kinematic viscosity at 100° C.. of about 5 to 20 cSt, more preferably about 7 to 16 cSt, most preferably about 9 to 13 cSt. In a preferred embodiment, the use of the viscosity index improver permits the omission of oil of viscosity about 20 cSt or more at 100° C.. from the lube base oil fraction used to make the present formulation. Therefore, a preferred base oil is one which contains little, if any, heavy fraction; e.g., little, if any, lube oil fraction of viscosity 20 cSt or higher at 100° C..

The lubricating oil basestock can be derived from natural lubricating oils, synthetic lubricating oils or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. Suitable basestocks include those in API categories I, II and III, where saturates level and Viscosity Index are:

Group I—less than 90% and 80–120, respectively;

Group II—greater than 90% and 80–120, respectively; and

Group III—greater than 90% and greater than 120, respectively.

Natural lubricating oils include animal oils, vegetable oils (e.g., rapeseed oils, castor oils and lard oil), petroleum oils, mineral oils, and oils derived from coal or shale.

Synthetic oils include hydrocarbon oils and halo-substituted hydro-carbon oils such as polymerized and interpolymerized olefins, alkylbenzenes, polyphenyls, alkylated diphenyl ethers, allylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with variety of alcohols. Esters useful as synthetic oils also include those made from $C._5$ to $C._{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofinans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydro-isomerization of natural or synthetic waxes or miuxtures thereof over a hydro-isomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and following dewaxing a pour point of about −20° C.. and lower.

The production of wax isomerate oil meeting the requirements of the present invention is disclosed and claimed in U.S. Pat. Nos. 5,049,299 and 5,158,671.

The detergent is a mixture of one or more metal salicylate detergents with one or more metal sulfonates and/or one or more metal phenates. The metals are any alkali or alkaline earth metals, e.g., calcium, barium, sodium, lithium, potassium, magnesium, more preferably calcium, barium and magnesium. It is a feature of the present lubricating oil that each of the metal salts or groups of metal salts used in the mixture has a different TBN as compared with the other metal salts or groups of metal salts in the mixture.

Thus, the mixture of detergents comprises a first metal salt or group of metal salts selected from the group consisting of one or more metal sulfonate(s), salicylate(s), phenate(s) and mixtures thereof having a high TBN of greater than about 150 to 300 or higher, preferably about 160 to 300, used in an amount in combination with the other metal salts or groups of metal salts (recited below) sufficient to achieve a lubricating oil of at least 0.65 wt % sulfated ash content, a second metal salt or group of metal salts selected from the group consisting of one or more metal salicylate(s), metal sulfonate(s), metal phenate(s) and mixtures thereof having a medium TBN of greater than about 50 to 150, preferably about 60 to 120, and a third metal salt or group of metal salts selected from the group consisting of one or more metal sulfonate(s), metal salicylate(s) and mixtures thereof identified as neutral or low TBN, having a TBN of about 10 to 50, preferably about 20 to 40, the total amount of medium plus neual/low TBN detergent being about 0.7 vol % or higher (active ingredient), preferably about 0.9 vol % or higher (active ingredient), most preferably about 1 vol % or higher (active ingredient), wherein at least one of the medium or low/neutral TBN detergent(s) is metal salicylate, preferably at least one of the medium TBN detergent(s) is a metal salicylate. The total amount of high TBN detergents is about 0.3 vol % or higher (active ingredient), preferably about 0.4 vol % or higher (active ingredient), most preferably about 0.5 vol % or higher (active ingredient). The mixture contains salts of at least two different types, with medium or neutral salicylate being an essential component. The volume ratio (based on active ingredient) of the high TBN detergent to medium plus neutral/low TBN detergent is in the range of about 0.15 to 3.5, preferably 0.2 to 2, most preferably about 0.25 to 1.

The mixture of detergents is added to the lubricating oil formulation in an amount up to about 10 vol % based on active ingredient in the detergent mixture, preferably in an amount up to about 8 vol % based on active ingredient, more preferably up to about 6 vol % based on active ingredient in the detergent mixture, most preferably between about 1.5 to 5.0 vol %, based on active ingredient in the detergent mixture. Preferably, the total amount of metal salicylate(s) used of all TBN's is in the range of between about 0.5 vol % to 4.5 vol %, based on active ingredient of metal salicylate.

The formulation may also contain one or more of the commonly used additives. Thus, in addition to the recited detergents, the oil composition can contain one or more antioxidants phenolic, aminic or other), viscosity index improvers, pour point depressants, antiwear/extreme pressure additives, antifoamant, dyes, metal deactivators, etc.

Anti-oxidants useful in the present invention may be of the phenol (e.g., o,o' ditertiary alkyl phenol such as diterliarybutyl phenol), or amine (e.g., dialkyl diphenylamine such as dibutyl, octylbutyl or dioctyl diphenylamine) type, or mixtures thereof. These should be substantially non-volatile at peak engine operating temperatures. By substantially non-volatile is meant that there is less than 10% volatility at about 150° C., preferably at about 175° C., most preferably at about 200° C. and higher. The term "phenol type" used herein includes compounds having one or more than one hydroxy group bound to an aromatic ring which may itself be mononuclear, e.g., benzyl, or polynuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof and bisphenol type compounds including such bi-phenol compounds linked by alkylene bridges or sulfur or oxygen bridges. Alkyl phenols include mono- and poly-alkyl or alkenyl phenols, the alkyl or alkenyl group containing from about 3–100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the "phenolic type" anti-oxidant may be represented by the general formula:

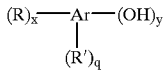

where Ar is selected from the group consisting of:

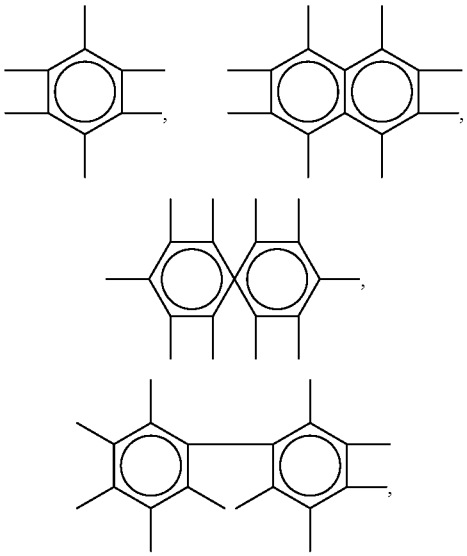

-continued

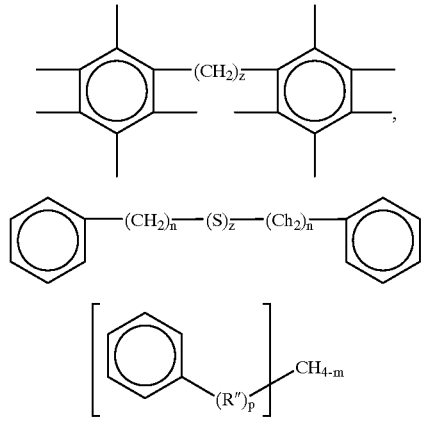

wherein R is a $C_{\cdot 3}$–$C_{\cdot 100}$ alkyl or alkenyl group, a sulfIr substituted alkyl or alkenyl group, preferably a $C_{\cdot 4}$–$C_{\cdot 50}$ alkyl or alkenyl group or sulfur substituted alkyl or alkenyl group, more preferably $C_{\cdot 3}$–$C_{\cdot 100}$ alkyl or sulfur substituted alkyl group, most preferably a $C_{\cdot 4}$–$C_{\cdot 50}$ alkyl group, y ranges from 1 to up to the available valences of Ar, x ranges from 0 to up to the available valances of Ar-y, Q ranges from 0 to up to the available valences of Ar+(x+y +p), z ranges from 1 to 10, n ranges from 0 to 20, and m is 0 to 4 and P is 0 or 1, preferably y ranges from 1 to 3, x ranges from 0 to 3, z ranges from 1 to 4 and n ranges from 0 to 5, p is 0 and Q is 0 or 1.

Most preferably the phenol is a hindered phenol such as di isopropyl phenol, di-tert butyl phenol di tert butyl alkylated phenol where the alkyl substitutent is hydrocarbyl and contains between 1 and 20 carbon atoms, such as 2,6 di-tert butyl- 4 methyl phenol, 2,6-di-tert butyl- 4-ethyl phenol, etc., or 2,6 di-tert butyl-4-alkoxy phenol.

Phenolic type anti-oxidants are well known in the lubricating industry and to those skilled in the art. The above is presented only by way of exemplification, not limitation on the type of phenolic anti-oxidants which can be used in the present invention.

The amine type antioxidants include diarylamines and thiodiaryl amines. Suitable diarylamines include diphenyl amine; phenyl-α-naphthylamine; phenyl-β-naphthylamine; α-α-di-naphthylamine; β-β-dinaphthylamine; or α-β-dinaphthylamine. Also suitable antioxidants are diarylamines wherein one or both of the aryl groups are alkylated, e.g., with linear or branched alkyl groups contaning 1 to 12 carbon atoms, such as the diethyl diphenylamines; dioctyldiphenyl amines, methyl phenyl-α-naphthylamines; phenyl-β-(butylnaphthyl) amine; di(4-methyl phenyl) amine or phenyl (3-propyl phenyl) amine octyl-butyl-diphenylamine, dioctyldiphenyl amine, octyl-, nonyl-diphenyl amine, dinonyl di phenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α(methyl naphthyl) amine; thio-di (ethyl phenyl)amine; (butyl phenyl) thio phenyl amine.

Other suitable antioxidants include s-triazines of the formula

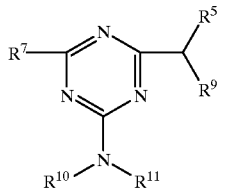

wherein $R^8$, $R_9$, $R_{10}$, $R_{11}$, are hydrogen, $C_1$ $C_{20}$ hydrocarbyl or pyridyl and $R^7$ is $C_{.1}$ to $C_{.8}$ hydrocarbyl $C_{.1}$ to $C_{.20}$ hydrocarbylamine, pyridyl or pyridylamine. If desired, mixtures of antioxidants may be present in the lubricant composition of the invention. The total amount of antioxidant or antioxidant mixtures used ranges from about 0.05 to 2.0 vol %, preferably about 0.1 to 1.75 vol %, most preferably about 0.5 to 1.5 vol %.

Viscosity index improvers useful in the present invention include any of the polymers which impart enhanced viscosity properties to the finished oil and are generally hydrocarbon-based polymers having a molecular weight, Mw, in the range of between about 2,000 to 1,000,000, preferably about 50,000 to 200,000. Viscosity index improver polymers typically include olefin copolymers, e.g., ethylene-propylene copolymers, ethylene-iso-)butylene copolymers, propylene-(iso-)butylene copolymers, ethylene-poly alpha olefin copolymers, polymethocrylates; styrene-diene block copolymers, e.g., styrene-isoprene copolymers, and star copolymers. Viscosity index improvers may be monofunctional or multifunctional, such as those bearing substitutents that provide a secondary lubricant performance feature such as dispersancy, pour point depression, etc.

Viscosity index improvers are lubricant additives well known in the lubricant industry and to those skilled in the at The above is presented only by way of example and not as a limitation on the types of viscosity index improvers which can be used in the present invention.

The amount of viscosity index improver used, be it mono functional or multifunctional, is in the amount of about 0.1 to 3 vol %, preferably about 0.2 to 2 vol %, most preferably about 0.3 to 1.5 vol %.

The fully formulated lubricating oil may contain other additional, typical additives known to those skilled in the industry, used on an as-received basis.

Thus, the fully formulated oil may contain dispersants of the type generally represented by succinimides (e.g., polyisobutylene succinic acid/anhydride (PIBSA)-polyamine having a PIBSA molecular weight of about 700 to 2500). The dispersants may be borated or non-borated. The dispersant can be present in the amount of about 0.5 to 8 vol %, more preferably in the amount of about 1 to 6 vol %, most preferably in the amount of about 2 to 4 vol %.

Metal deactivators may be of the aryl thiazines, triazoles, or alkyl substituted dimercapto thiadiazoles (DMTD's), or mixtures thereof. Metal deactivators can be present in the amount of about 0.01 to 0.2 vol %, more preferably in the amount of about 0.02 to 0.15 vol %, most preferably in the amount of about 0.05 to 0.1 vol %.

Antiwear additives such as metal dithiophosphates (e.g., zinc dialkyl dithiophosphate, ZDDP), metal dithiocarbamates, metal xanthates or tricresylphosphates may be included. Antiwear additives can be present in the amount of about 0.05 to 1.5 vol %, more preferably in the amount of about 0.1 to 1.0 vol %, most preferably in the amount of about 0.2 to 0.5 vol %.

Pour point depressants such as poly(meth)acrylates, or alkylaromatic polymers may be included. Pour point depressants can be present in the amount of about 0.05 to 0.6 vol %, more preferably in the amount of about 0.1 to 0.4 vol %, most preferably in the amount of about 0.2 to 0.3 vol %.

Antifoamants such as silicone antifoaming agents can be present in the amount of about 0.001 to 0.2 vol %, more preferably in the amount of about 0.005 to 0.15 vol %, most preferably in the amount of about 0.01 to 0.1 vol %.

Lubricating oil additives are described generally in "Lubricants and Related Products" by Dieter Klamann, Verlag C.hemie, Deerfield, Fla., 1984, and also in "Lubricant Additives" by C.. V. Smalheer and R. Kennedy Smith, 1967, page 1–11, the disclosures of which are incorporated herein by reference.

The present invention is illustrated further in the following nonlimiting examples and comparative examples.

EXPERIMENTAL

Lab Nitration Screener Test Results

A lab nitration screener test was used in initial experiments to guide in the selection of detergents, antioxidants, and viscosity index improvers (VIs). The test results identify a number of parameters for assessing the used oil performance, including viscosity increase, oxidation, and nitration. All measurements are reported on a relative basis so that large results or values represent greater levels of lubricant degradation. Thus, numerically lower results represent a measure of longer oil life. In each test, a Reference Oil is always tested. All results are reported as a ratio of the result for the oil tested divided by the result for a Reference Oil. For example, if a tested oil has an oxidation result of 1.0, then it has an oxidation performance equal to that of the Reference Oil. If the tested oil has an oxidation result less than 1.0, then the tested oil demonstrates oxidation performance superior to that of the Reference Oil.

EXAMPLES

Lab nitration screener test results are summarized in Table 1. Results are measured relative to Reference Oil B, which is a commercial medium ash gas engine oil based on solvent-extracted basestocks. Reference Oil B is the most widely sold medium ash gas engine oil in C.anada and therefore represents a "benchmark standard" against which other formulations useful as engine oils may be measured. C.omparative Oil 1 is another commercial medium ash gas engine oil, formulated with Oloa 1255 additive package in solvent-extracted basestocks. Oloa 1255 is one of the most widely sold gas engine oil additive packages and therefore C.omparative Oil 1 represents another "bench-mark standard" against which other formulations may be measured. C.omparative Oil 2 is a medium ash formulation blended using a combination of low TBN calcium sulphonate, medium TBN calcium phenate and high TBN calcium phenate.

Results show that the oil of the present invention, Example 1, demonstrates superior performance to those of the C.omparative oils, in terms of reduced oxidation, nitration and viscosity increase, and superior performance to that of Reference Oil B in terms of reduced oxidation and nitration and equal to Reference Oil B for reduced viscosity increase. Example 1 contains a mixture of three metal salt detergents, one each from the group high TBN, medium TBN and low/neutral TBN detergents, wherein at least one metal salicylate is used as the medium or low/neutral salt detergent. The invention provided performance superior to that of the other oils that used different detergents or mixtures of detergents.

TABLE 1

TEST FORMULATIONS AND NITRATION TEST RESULTS

| Component (vol %) | Description | Reference Oil B | Comparative Oil 1 | Comparative Oil 2 | Reference Oil B* | Example 1 |
|---|---|---|---|---|---|---|
| | Commercial oil | 100.00 | — | — | 100.0 | — |
| | Commercial oil | — | 100.00 | — | — | — |
| | 600 SN base oil | — | — | 86.70 | — | — |
| | 1200 SN base oil | — | — | 2.68 | — | — |
| | 150 SN base oil | — | — | — | — | 4.35 |
| | 600 SN base oil | — | — | — | — | 86.20 |
| | 135 TBN Ca phenate detergent | — | — | 2.47 | — | — |
| | Neutral Ca sulphonate (26 TBN) | — | — | 0.81 | — | 0.81 |
| | Dispersant | — | — | 4.00 | — | — |
| | Metal deactivator | — | — | 0.05 | — | — |
| | ZDDP | — | — | 0.29 | — | — |
| | Antifoamant | — | — | 0.05 | — | — |
| | Pour point depressant | — | — | 0.40 | — | — |
| | Antioxidant | — | — | 1.00 | — | — |
| | Balance of additive system | — | — | — | — | 5.79 |
| | Neutral Ca alkylsalicylate (64 TBN) | — | — | — | — | 2.00 |
| | Overbased Ca phenate (190 TBN) | — | — | 1.55 | — | — |
| | Overbased Ca sulphonate (300 TBN) | — | — | — | — | 0.85 |
| Viscosity | measured kV @ 1000° C. | 13.55 | 13.53 | 13.54 | 13.46 | 13.19 |
| Nitration Test | oxidation (relative) | 1.00 | 1.11 | 0.90 | 1.00 | 0.62 |
| | nitration (relative) | 1.00 | 1.04 | 1.16 | 1.00 | 0.77 |
| | viscosity increase (relative) | 1.00 | 1.62 | 1.24 | 1.00 | 1.00 |
| | Total medium + low TBN detergents vol %, by a.i. | N/A | — | 1.47 | N/A | 1.36 |
| | Total high TBN detergents vol %, by a.i. | N/A | — | 0.62 | N/A | 0.47 |
| | High:medium + low TBN detergents ratio, vol % | N/A | — | 0.42 | N/A | 0.35 |

Notes: (1) B* is a repeat blend of B using same components and exact same formulation.

What is claimed is:

1. A long life lubricant comprising a major amount of an oil of lubricating viscosity and a minor amount of additives comprising a mixture of detergents comprising a first metal salt or group of metal salts selected from the group consisting of one or more metal salicylate(s), metal sulfonate(s), metal phenate(s), and mixtures thereof having a high Total Base Number (TBN) of greater than about 150 or higher used in an amount in combination with the other metal salts or groups of metal salts sufficient to achieve a lubricating oil of at least 0.65 wt % sulfated ash content, a second metal salt or group of metal salts selected from the group consisting of one or more metal salicylate(s) metal sulfonate(s), metal phenate(s) and mixture thereof having a medium TBN of greater than about 50 to 150, and a third metal salt or group of metal salts selected from the group consisting of one or more metal sulfonate(s), metal salicylate(s) and mixtures thereof having a low/neutral TBN of about 10 to 50, the total amount of medium plus low/neutral TBN detergents being about 0.7 vol % or higher (based on active ingredient), the total amount of high TBN detergents being about 0.3 vol % or higher (based on active ingredient) and the volume ratio (based on active ingredient) of high TBN detergent to medium plus low/neutral TBN detergent is in the range of about 0.15 to 3.5, wherein at least one of the medium or low/neutral TBN detergent(s) is metal salicylate.

2. The long life lubricant composition of claim 1 wherein the at least one of the medium TBN detergent(s) is a metal salicylate.

3. The long life lubricant composition of claim 1 wherein the metal components of the metal sulfonate, metal phenate and metal salicylate are the same or different and are selected from the group consisting of alkali metals and alkaline earth metals.

4. The long life lubricant composition of claim 1 wherein the total amount of the metal salicylate(s) in the mixture is in the amount of 0.5 to 4.5 vol % based on active ingredient.

5. The long life lubricant composition of claim 4 wherein the mixture of detergents is present in an amount up to about 10 vol % based on active ingredients.

6. The long life lubricant of claim 1 wherein the total amount of medium plus low/neutral TBN detergent is about 0.9 vol % or higher, based on active ingredient.

7. The long life lubricant of claim 1 wherein the total amount of medium plus low/neutral TBN detergent is about 1 vol % or higher, based on active ingredient.

8. The long life lubricant of claim 1, 2, 3, 4, 5, 6 or 7 wherein the total amount of high TBN detergent is about 0.4 vol % or higher, based on active ingredient.

9. The long life lubricant of claim 1, 2, 3, 4, 5, 6 or 7 wherein the total amount of high TBN detergent is about 0.5 vol % or higher, based on active ingredient.

10. The long life lubricant composition of claim 1, 2, 3, 4, 5, 6 or 7 wherein the volume ratio, based on active ingredient, of the high TBN detergent to the medium plus low/neutral TBN detergent is in the range of about 0.2 to 2.

11. The long life lubricant composition of claim 1, 2, 3, 4, 5, 6 or 7 wherein the volume ratio, based on active ingredient of the high TBN detergent to the medium plus low/neutral TBN detergent is in the range of about 0.25 to 1.

12. The long life lubricant composition of claim 8 wherein the volume ratio, based on active ingredient, of the high TBN detergent to the medium plus low/neutral TBN detergent is in the range of about 0.2 to 2.

13. The long life lubricant composition of claim 8 wherein the volume or ratio, based on active ingredient, of the high TBN detergent to the medium plus low/neutral TBN detergent is in the range of about 0.25 to 1.

14. The lubricant composition of claim 1 wherein the first metal salt has a TBN of greater than about 150 to 300.

15. A method for enhancing the life of a lubricating oil composition as evidenced by a reduction in viscosity increase, oxidation and nitration by adding to the oil a minor amount of additives comprising a mixture of detergents comprising a first metal salt or group of metal salts selected from the group consisting of one or more metal salicylate(s), metal sulfonate(s), metal phenate(s), and mixtures thereof having a high Total Base Number (TBN) of greater than about 150 or higher used in an amount in combination with the other metal salts or groups of metal salts sufficient to achieve a lubricating oil of at least 0.65 wt % sulfated ash content, a second metal salt or group of metal salts selected from the group consisting of one or more metal salicylate(s), metal sulfonate(s), metal phenate(s), and mixture thereof having a medium TBN of greater than about 50 to 150, and a third metal salt or group of metal salts selected from the group consisting of one or more metal sulfonate(s), metal salicylate(s) and mixtures thereof having a low/neutral TBN of about 10 to 50, the total amount of medium plus low/neutral TBN detergents being about 0.7 vol % or higher (based on active ingredient), the total amount of high TBN detergents being about 0.3 vol % or higher (based on active ingredient) and the volume ratio (based on active ingredient) of high TBN detergent to medium plus low/neutral TBN detergent is in the range of about 0.15 to 3.5, wherein at least one of the medium or low/neutral TBN detergent(s) is metal salicylate.

16. The method of claim 15 wherein the at least one of the medium TBN detergent(s) is a metal salicylate.

17. The method of claim 15 wherein the metal components of the metal sulfonate, metal phenate and metal salicylate are the same or different and are selected from the group consisting of alkali metals and alkaline earth metals.

18. The method of claim 15 wherein the total amount of the metal salicylate(s) in the mixture is in the amount of 0.5 to 4.5 vol % based on active ingredient.

19. The method of claim 15 wherein the mixture of detergents is present in an amount up to about 10 vol % based on active ingredients.

20. The method of claim 15 wherein the total amount of medium plus low/neutral TBN detergent is about 0.9 vol % or higher, based on active ingredient.

21. The method of claim 15 wherein the total amount of medium plus low/neutral TBN detergent is about 1 vol % or higher, based on active ingredient.

22. The method of claim 15, 16, 17, 18, 19, 20 or 21 wherein the total amount of high TBN detergent is about 0.4 vol % or higher, based on active ingredient.

23. The method of claim 15, 16, 17, 18, 19, 20 or 21 wherein the total amount of high TBN detergent is about 0.5 vol % or higher, based on active ingredient.

24. The method of claim 15, 16, 17, 18, 19, 20 or 21 wherein the volume ratio, based on active ingredient, of the high TBN detergent to the medium plus low/neutral TBN detergent is in the range of about 0.2 to 2.

25. The method of claim 15, 16, 17, 18, 19, 20 or 21 wherein the volume ratio, based on active ingredient, of the high TBN detergent to the medium plus low/neutral TBN detergent is in the range of about 0.25 to 1.

26. The method of claim 22 wherein the volume ratio, based on active ingredient, of the high TBN detergent to the medium plus low/neutral TBN detergent is in the range of about 0.2 to 2.

27. The method of claim 23 wherein the volume or ratio, based on active ingredient, of the high TBN detergent to the medium plus low/neutral TBN detergent is in the range of about 0.25 to 1.

28. The method of claim 15 wherein the first metal salt has a TBN of greater than about 150 to 300.

* * * * *